US010481522B2

(12) United States Patent
Shimizu et al.

(10) Patent No.: US 10,481,522 B2
(45) Date of Patent: Nov. 19, 2019

(54) DEVELOPING DEVICE WITH DEVELOPING ROLLER AND THICKNESS REGULATING MEMBER AND IMAGE FORMING APPARATUS PROVIDED WITH SAME

(71) Applicant: KYOCERA Document Solutions Inc., Osaka-shi (JP)

(72) Inventors: Tamotsu Shimizu, Osaka (JP); Yasuhiro Tauchi, Osaka (JP); Akifumi Yamaguchi, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 16/240,896

(22) Filed: Jan. 7, 2019

(65) Prior Publication Data

US 2019/0219945 A1 Jul. 18, 2019

(30) Foreign Application Priority Data

Jan. 12, 2018 (JP) ..... 2018-003218

(51) Int. Cl.
*G03G 15/08* (2006.01)
*G03G 15/09* (2006.01)

(52) U.S. Cl.
CPC ..... *G03G 15/0812* (2013.01); *G03G 15/0808* (2013.01); *G03G 15/09* (2013.01); *G03G 15/0921* (2013.01)

(58) Field of Classification Search
CPC ..... G03G 15/0812; G03G 15/09
USPC ..... 399/274, 275
See application file for complete search history.

(56) References Cited

U.S. PATENT DOCUMENTS 4,451,134 A 5/1984 Fukuchi et al.
6,070,037 A * 5/2000 Sugihara ..... G03G 15/09 399/103
8,494,418 B2 * 7/2013 Mabuchi ..... G03G 15/0812 399/275

FOREIGN PATENT DOCUMENTS

JP 58-105264 6/1983
JP 60-095570 5/1985
JP 2003122113 A * 4/2003
JP 2004133019 A * 4/2004
JP 2005099486 A * 4/2005
JP 2007121708 A * 5/2007
JP 2009134009 A * 6/2009
JP 2014089386 A * 5/2014

* cited by examiner

*Primary Examiner* — Robert B Beatty
(74) *Attorney, Agent, or Firm* — Gerald E. Hespos; Michael J. Porco; Matthew T. Hespos

(57) ABSTRACT

A developing device includes a developing roller and a layer thickness regulating member. The developing roller includes a fixed magnet and a sleeve. The layer thickness regulating member includes a regulating body portion and an upstream regulating portion, and the upstream regulating portion includes an upstream magnetic member and a nonmagnetic member. Developer is hardly strongly jammed in an area between a first magnetic field concentration point of the regulating body portion and a second magnetic field concentration point of the upstream regulating portion. Thus, even if the sleeve of the developing roller is rotated at a higher speed than before, the developer is stably regulated by the layer thickness regulating member.

9 Claims, 14 Drawing Sheets

DEVELOPING DEVICE WITH DEVELOPING ROLLER AND THICKNESS REGULATING MEMBER AND IMAGE FORMING APPARATUS PROVIDED WITH SAME

This application relates to and claims priority from Japanese Patent Application No. 2018-003218 filed in the Japan Patent Office on Jan. 12, 2018, the entire disclosure of which is incorporated herein by reference.

BACKGROUND

The present disclosure relates to a developing device and an image forming apparatus provided with the same.

Conventionally, an electrophotographic image forming apparatus such as a printer or a copier includes a photoconductive drum for carrying an electrostatic latent image, a developing device for developing the electrostatic latent image into a toner image by supplying toner to the photoconductive drum and a transfer device for transferring the toner image from the photoconductive drum to a sheet.

The developing device includes a developing roller for supplying toner to the photoconductive drum. The developing roller includes a fixed magnet having a plurality of magnetic poles and a sleeve configured to rotate around the magnet. In a two-component developing method, developer containing toner and magnetic carrier is carried on the sleeve of the developing roller. A developer conveying amount is regulated by a layer thickness regulating member arranged to face the developing roller.

In such a two-component developing method, it is important for stable image quality to stabilize the developer conveying amount on the developing roller. This developer conveying amount is mainly determined by (1) the size of a gap (regulation gap) between the layer thickness regulating member and the developing roller, (2) the density of the developer retained on a side upstream of the layer thickness regulating member, (3) a regulating force by a magnetic force around the layer thickness regulating member, and (4) a developer conveying force by the developing roller.

Conventionally, a technique for concentrating a magnetic force on the layer thickness regulating member is known as a regulating method for stabilizing the above developer conveying amount.

SUMMARY

A developing device according to one aspect of the present disclosure includes a housing, a developing roller, a developer stirring member and a layer thickness regulating member. Developer containing toner and magnetic carrier is stored in the housing. The developing roller includes a fixed magnet having a plurality of magnetic poles along a circumferential direction and a sleeve configured to rotate in a predetermined rotating direction around the fixed magnet and carry the developer on a circumferential surface, is so supported in the housing as to face a photoconductive drum, on a surface of which an electrostatic latent image is to be formed, at a predetermined developing position and supplies the toner to the photoconductive drum. The developer stirring member is rotatably supported in the housing, stirs the developer and supplies the developer to the developing roller. The layer thickness regulating member is arranged to face the sleeve of the developing roller and regulates a layer thickness of the developer supplied to the developing roller by the developer stirring member. The fixed magnet has a regulation pole arranged to face the layer thickness regulating member and having a predetermined polarity. The layer thickness regulating member includes a regulating body portion and an upstream regulating portion. The regulating body portion is made of a magnetic material and regulates the layer thickness of the developer being conveyed toward the developing position. The regulating body portion has a first facing surface arranged at a predetermined distance from the sleeve, a first upstream side surface connected to an upstream end part of the first facing surface in the rotating direction and extending along a radial direction of the sleeve and a first downstream side surface connected to the first facing surface on a side opposite to the first upstream side surface in the rotating direction. The upstream regulating portion is connected to the first upstream side surface of the regulating body portion. The upstream regulating portion has a second facing surface arranged to face the sleeve at a larger distance from the sleeve than the first facing surface, a second downstream side surface connected to a downstream end part of the second facing surface in the rotating direction, extending along the radial direction and held in close contact with the first upstream side surface and a second upstream side surface connected to the second facing surface on a side opposite to the second downstream side surface in the rotating direction. The second facing surface of the upstream regulating portion has a nonmagnetic facing surface arranged downstream of the second facing surface in the rotating direction and made of a nonmagnetic material, and an upstream magnetic facing surface arranged upstream of the second facing surface in the rotating direction and made of a magnetic material.

A image forming apparatus according to another aspect of the present disclosure includes the developer device, the photoconductive drum and a transfer unit. The photoconductive drum is configured such that the toner is supplied thereto from the developing device and a toner image is carried on the circumferential surface. The transfer unit is configured to transfer the toner image from the photoconductive drum to a sheet.

DETAILED DESCRIPTION

Hereinafter, an image forming apparatus 10 according to a first embodiment of the present disclosure is described on the basis of the drawings. In this embodiment, a tandem color printer is illustrated as an example of the image forming apparatus. The image forming apparatus may be, for example, a copier, a facsimile machine, a complex machine of these or the like.

Figure 1:
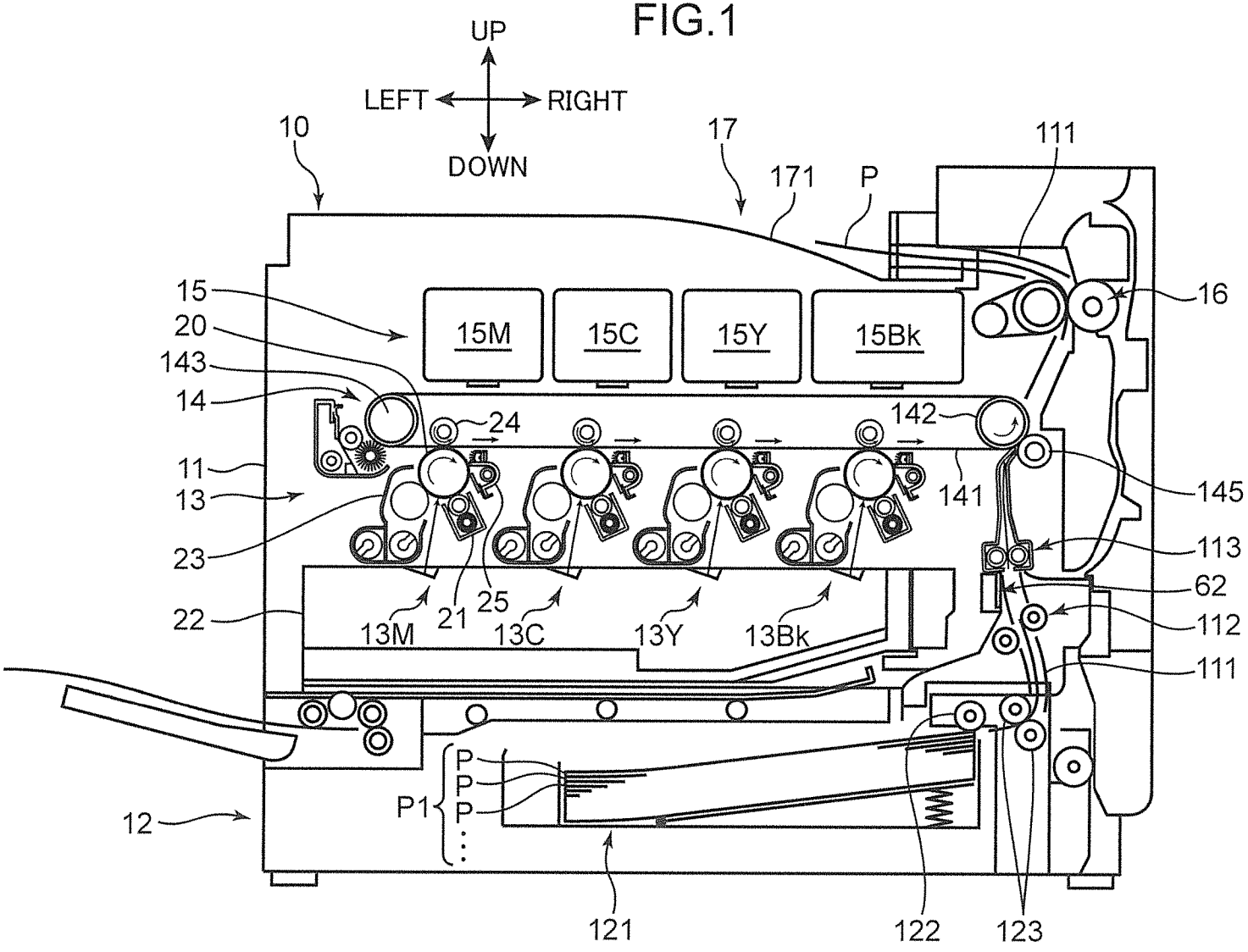
FIG. 1 is a sectional view showing an internal structure of an image forming apparatus according to a first embodiment of the present disclosure.

FIG. 1 is a sectional view showing an internal structure of the image forming apparatus 10. This image forming apparatus 10 includes an apparatus body 11 having a box-shaped housing structure. A sheet feeding unit 12 for feeding sheets P, an image forming station 13 for forming a toner image to be transferred to the sheet P fed from the sheet feeding unit 12, an intermediate transfer unit 14, to which toner images are to be primarily transferred, a secondary transfer roller 145, a toner replenishing unit 15 for replenishing toner to the image forming station 13 and a fixing unit 16 for fixing the unfixed toner image formed on the sheet P to the sheet P are integrally equipped in this apparatus body 11. Further, a sheet discharging portion 17 to which the sheet P having a fixing process applied thereto in the fixing unit 16 is to be discharged is provided on the top of the apparatus body 11.

A sheet conveyance path III vertically extending at a position to the right of the image forming station 13 is further formed in the apparatus body 11. A pair of conveyor rollers 112 for conveying the sheet are provided at a suitable position in the sheet conveyance path 111. Further, a pair of registration rollers 113 for performing the skew correction of the sheet and feeding the sheet at a predetermined timing to a secondary transfer nip portion to be described later are also provided upstream of the nip portion in the sheet conveyance path 111. The sheet conveyance path 111 is a conveyance path for conveying the sheet P from the sheet feeding unit 12 to the sheet discharging portion 17 by way of the image forming station 13 (secondary transfer nip portion) and the fixing unit 16.

The sheet feeding unit 12 includes a sheet tray 121, a pickup roller 122 and a pair of sheet feed rollers 123. The sheet tray 121 is detachably inserted to a lower position of the apparatus body 11 and stores a sheet bundle P1 in which a plurality of sheets P are stacked. The pickup roller 122 picks up the uppermost sheet P of the sheet bundle P1 stored in the sheet tray 121 one by one. The pair of sheet feed rollers 123 feed the sheet P picked up by the pickup roller 122 to the sheet conveyance path 111.

The image forming station 13 is for forming a toner image on the sheet P and includes a plurality of image forming units for forming toner images of different colors. A magenta unit 13M using magenta (M) developer, a cyan unit 13C using cyan (C) developer, a yellow unit 13Y using yellow (Y) developer and a black unit 13Bk using black (Bk) developer successively disposed from an upstream side to a downstream side (from a left side to a right side shown in FIG. 1) in a rotating direction of an intermediate transfer belt 141 to be described later are provided as the image forming units in this embodiment. Each unit 13M, 13C, 13Y or 13Bk includes a photoconductive drum 20 and a charging device 21, a developing device 23 and a cleaning device 25 arranged around the photoconductive drum 20. Further, an exposure device 22 common to the respective units 13M, 13C, 13Y and 13Bk is arranged below the image forming units.

The photoconductive drum 20 is driven to rotate about a shaft thereof and an electrostatic latent image and a toner image are formed on a circumferential surface thereof. The photoconductive drum 20 is arranged to correspond to each of the image forming units of the respective colors. The charging device 21 uniformly charges the surface of the photoconductive drum 20. The charging device 21 includes a charging roller and a charging cleaning brush for removing the toner adhering to the charging roller. The exposure device 22 includes various optical devices such as a light source, a polygon mirror, reflection mirrors and deflection mirrors, and forms an electrostatic latent image on the uniformly charged circumferential surface of the photoconductive drum 20 by irradiating light modulated based on image data. Further, the cleaning device 25 cleans the circumferential surface of the photoconductive drum 20 after the transfer of the toner image.

The developing device 23 supplies the toner to the circumferential surface of the photoconductive drum 20 to develop the electrostatic latent image formed on the photoconductive drum 20. The developing device 23 is for two-component developer composed of toner and carrier. Note that the toner has a property of being positively charged in this embodiment.

The intermediate transfer unit 14 is arranged in a space provided between the image forming station 13 and the toner replenishing unit 15. The intermediate transfer unit 14 includes the intermediate transfer belt 141, a drive roller 142, a driven roller 143 and a primary transfer roller 24.

The intermediate transfer belt 141 is an endless belt-like rotating body and so stretched between the drive roller 142 and the driven roller 143 that a peripheral surface side thereof comes into contact with the circumferential surface of each photoconductive drum 20. The intermediate transfer belt 141 is driven to circulate in one direction to carry toner images transferred from the photoconductive drums 20.

The drive roller 142 stretches the intermediate transfer belt 141 on a right end side of the intermediate transfer belt 141 and drives to circulate the intermediate transfer belt 141. The drive roller 142 is formed of a metal roller. The driven roller 143 stretches the intermediate transfer belt 141 on a left end side of the intermediate transfer unit 14. The driven roller 143 applies tension to the intermediate transfer belt 141.

The primary transfer roller 24 forms a primary transfer nip portion by sandwiching the intermediate transfer belt 141 between the photoconductive drum 20 and the primary transfer roller 24, and primarily transfers the toner image on the photoconductive drum 20 onto the intermediate transfer belt 141. The primary transfer roller 24 is arranged to face the photoconductive drum 20 of each color.

The secondary transfer roller 145 is arranged to face the drive roller 142 across the intermediate transfer belt 141. The secondary transfer roller 145 forms a secondary transfer nip portion by being pressed into contact with the peripheral surface of the intermediate transfer belt 141. The toner image primarily transferred onto the intermediate transfer belt 141 is secondarily transferred to the sheet P fed from the sheet feeding unit 12 in the secondary transfer nip portion. The intermediate transfer unit 14 and the secondary transfer roller 145 of this embodiment constitute a transfer unit of the present disclosure. The transfer unit transfers the toner image from the photoconductive drums 20 to the sheet P.

The toner replenishing unit 15 is for storing the toner used for image formation and includes a magenta toner container 15M, a cyan toner container 15C, a yellow toner container 15Y and a black toner container 15Bk in this embodiment. These toner containers 15M, 15C, 15Y and 15Bk replenish the toner of each color to the developing devices 23 of the image forming units 13M, 13C, 13Y and 13Bk corresponding to the respective colors MCYBk through unillustrated toner conveying units.

The sheet P fed to the fixing unit 16 is heated and pressed by passing through a fixing nip portion. In this way, the toner image transferred to the sheet P in the secondary transfer nip portion is fixed to the sheet P.

The sheet discharging portion 17 is formed by recessing a top part of the apparatus body 11 and a sheet discharge tray 171 for receiving the discharged sheet P is formed in a bottom part of this recess. The sheet P having the fixing process applied thereto is discharged to the sheet discharge tray 171 by way of the sheet conveyance path 111 extending from the top of the fixing unit 16.

Figure 2:
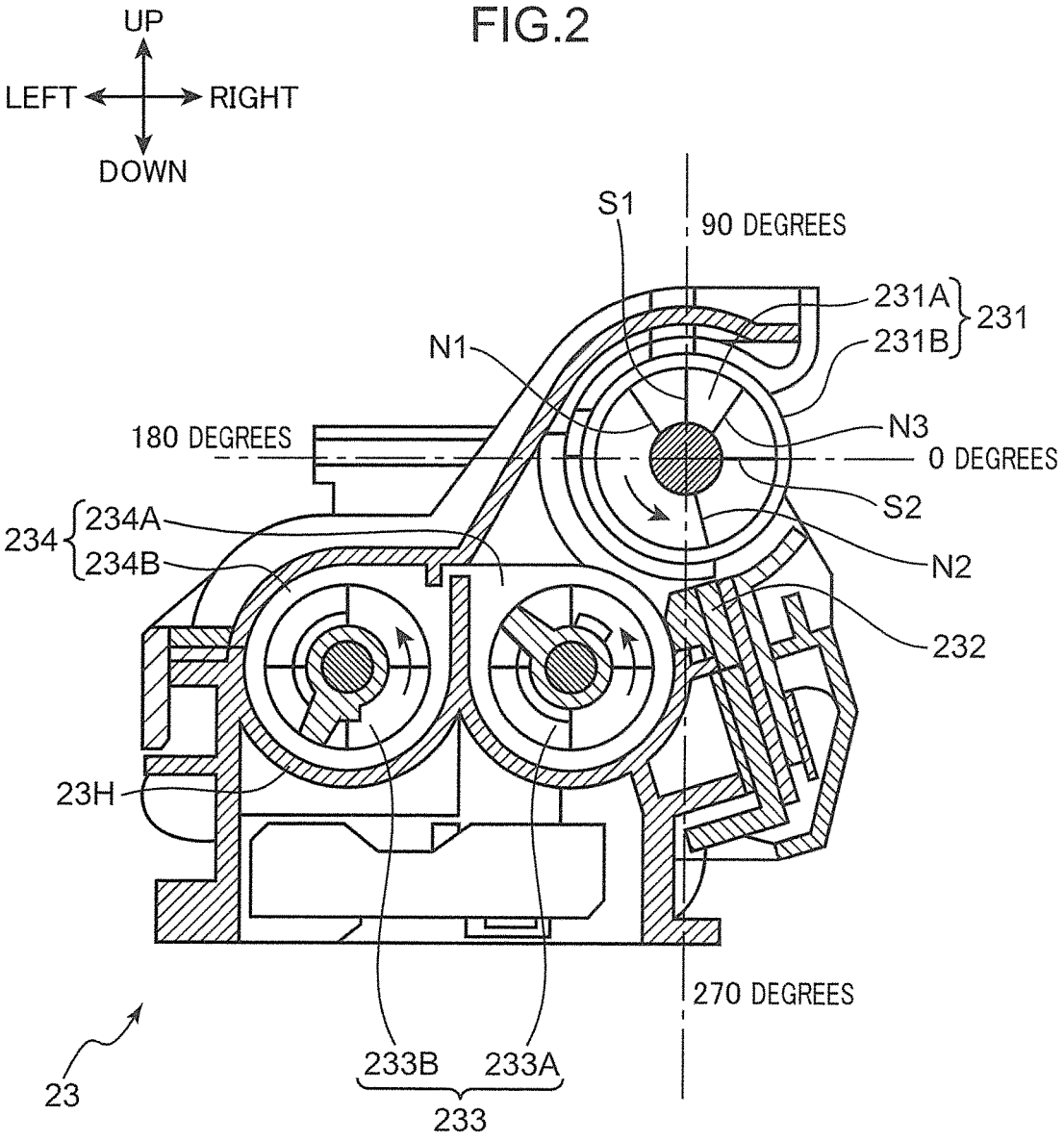
FIG. 2 is a schematic sectional view showing an internal structure of a developing device according to the first embodiment of the present disclosure.

Next, the developing device 23 according to this embodiment is described in more detail with reference to FIG. 2. FIG. 2 is a schematic sectional view showing an internal structure of the developing device 23 according to this embodiment. A rotating direction of each rotating member of the developing device 23 is shown by an arrow in FIG. 2.

The developing device 23 includes a housing 23H, a developing roller 231, a layer thickness regulating member 232, stirring screws 233 and a developer conveying unit 234. The housing 23H is a housing part for supporting each member of the developing device 23. The developer containing the toner and the magnetic carrier is stored in the housing 23H.

The developing roller 231 is so supported in the housing 23H as to face the photoconductive drum 20, on the surface of which an electrostatic latent image is to be formed, at a predetermined developing position, and supplies the toner to the photoconductive drum 20. The developing roller 231 includes a fixed magnet 231A and a sleeve 231B (FIG. 2). Note that, in this embodiment, the developing position may be a position where the photoconductive drum 20 and the developing roller 231 are closest to each other. The fixed magnet 231A is a cylindrical magnet including a plurality of magnetic poles along a circumferential direction and fixed to the housing 23H. The sleeve 231B rotates in a predetermined rotating direction (see an arrow of FIG. 2) around the fixed magnet 231A and carries the developer containing the toner and the magnetic carrier on a circumferential surface. In this embodiment, the sleeve 231B is formed of a cylindrical tube member (base member) made of aluminum. A plurality of recesses arranged at intervals in an axial direction and the circumferential direction are formed substantially in the entire circumferential surface of the cylindrical tube member of the sleeve 231B.

Note that a development bias in which an alternating-current bias is superimposed on a direct-current bias is applied to the developing roller 231. Further, the developing roller 231 and the photoconductive drum 20 are rotated in the same direction (also referred to as a with-direction or trail direction) at the developing position.

The layer thickness regulating member 232 is a plate-like member arranged to face the sleeve 231B of the developing roller 231. The layer thickness regulating member 232 regulates a layer thickness of the developer supplied to the developing roller 231 by a first screw 233A of the stirring screws 233. Further, the layer thickness regulating member 232 is arranged below the developing roller 231.

The stirring screws 233 charges the toner by conveying the two-component developer in a circulating manner while stirring this developer. The stirring screws 233 include the first screw 233A (developer stirring member) and a second screw 233B. The first and second screws 233A, 233B are rotatably supported in the housing 23H. Further, each of the first and second screws 233A, 233B has such a screw shape that a spiral blade is provided around a shaft.

The developer conveying unit 234 is a circulation path for the developer formed in the housing 23H. The developer conveying unit 234 includes a first conveying portion 234A having the first screw 233A arranged therein and a second conveying portion 234B having the second screw 233A arranged therein (see FIG. 2). The first and second conveying portions 234A, 234B are partitioned by a plate-like partitioning member. Note that both axial end parts of the first and second conveying portions 234A, 234B communicate with each other. The developer is conveyed in a circulating manner between the first and second conveying portions 234A, 234B. The first screw 233A supplies the developer to the developing roller 231. Further, the toner replenished from the toner replenishing unit 15 flows into the housing 23H from one axial end side of the second conveying portion 234B and is stirred with the other developer.

Note that, as shown in FIG. 1, an axis of the developing roller 231 is arranged below that of the photoconductive drum 20 and an axis of the first screw 233A is arranged further below that of the developing roller 231 (FIG. 2).

Further, with reference to FIG. 2, the developer composed of the toner and the carrier and conveyed in a circulating manner by the stirring screws 233 is supplied from the first screw 233A to the developing roller 231. Thereafter, when part of the toner is supplied to the photoconductive drum 20 at the developing position after the layer thickness of the developer is regulated by the layer thickness regulating member 232, the developer is separated from the developing roller 231. Thereafter, the separated developer flows into the first conveying portion 234A around the first screw 233A again.

With reference to FIG. 2, the fixed magnet 231A of the developing roller 231 includes five magnetic poles along the circumferential direction in this embodiment. An S2 pole is arranged near the developing position where the developing roller 231 and the photoconductive drum 20 face each other. The S2 pole functions as a main pole for supplying the toner to the photoconductive drum 20. Further, an N3 pole is arranged downstream of the S2 pole in a rotating direction of the sleeve 231B. Also, an S1 pole is arranged downstream of the N3 pole in the rotating direction. Further, an N1 pole is arranged downstream of the S1 pole in the rotating direction. Further, an N2 pole is arranged downstream of and at a predetermined distance from the N1 pole in the rotating direction. Note that, in other words, the N1 pole is a magnetic pole arranged downstream of the developing position in the rotating direction and having a predetermined polarity and the N2 pole is a magnetic pole arranged downstream of the N1 pole in the rotating direction and having the same polarity as the N1 pole. The N2 pole is arranged to face the layer thickness regulating member 232. The N2 pole functions as a draw-up pole for forming a magnetic field for receiving the developer supplied by the first screw 233A on the side of the sleeve 231B. Further, the N2 pole also functions as a regulation pole for forming a magnetic field for regulating the layer thickness of the developer supplied to the developing roller 231 between the layer thickness regulating member 232 and the N2 pole. Also, the N1 pole is arranged above the N2 pole. Further, the N1 pole is arranged above the axis of the developing roller 231 and the N2 pole is arranged below the axis of the developing roller 231.

Figure 3:
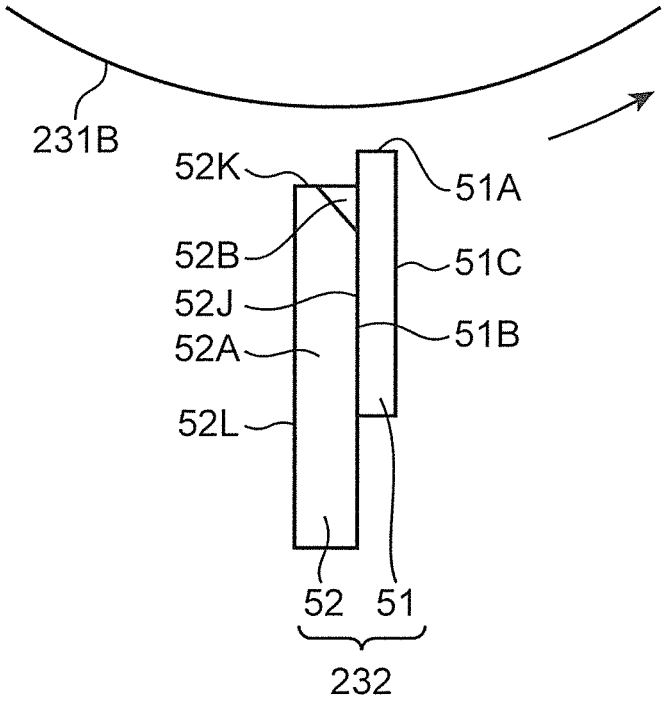
FIG. 3 is a schematic sectional view showing a developing roller and a layer thickness regulating member according to the first embodiment of the present disclosure.
Figure 4:
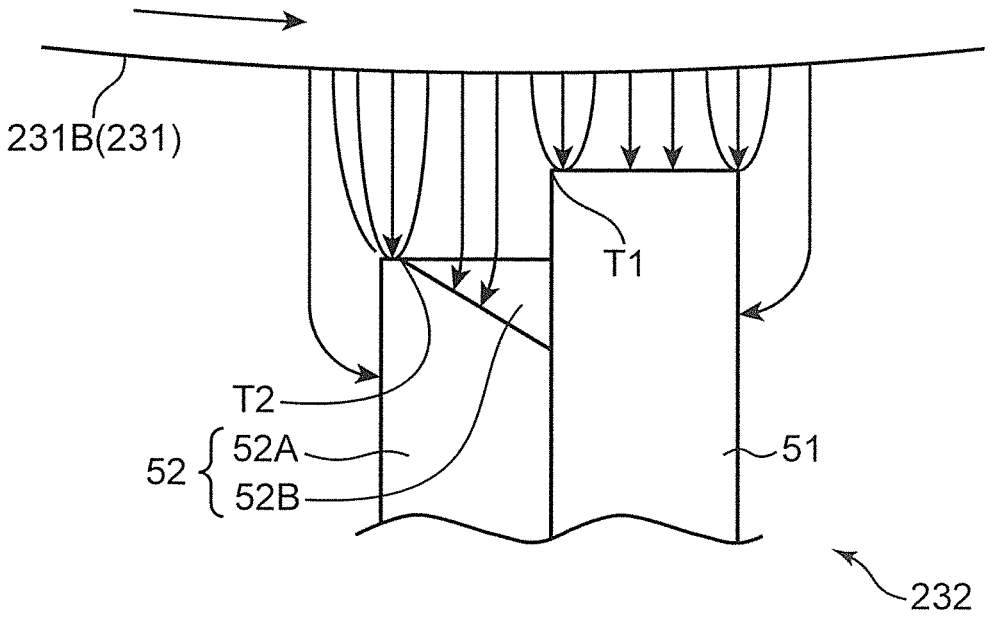
FIG. 4 is a schematic view showing a state of a magnetic field formed between the developing roller and the layer thickness regulating member according to the first embodiment of the present disclosure.
Figure 5:
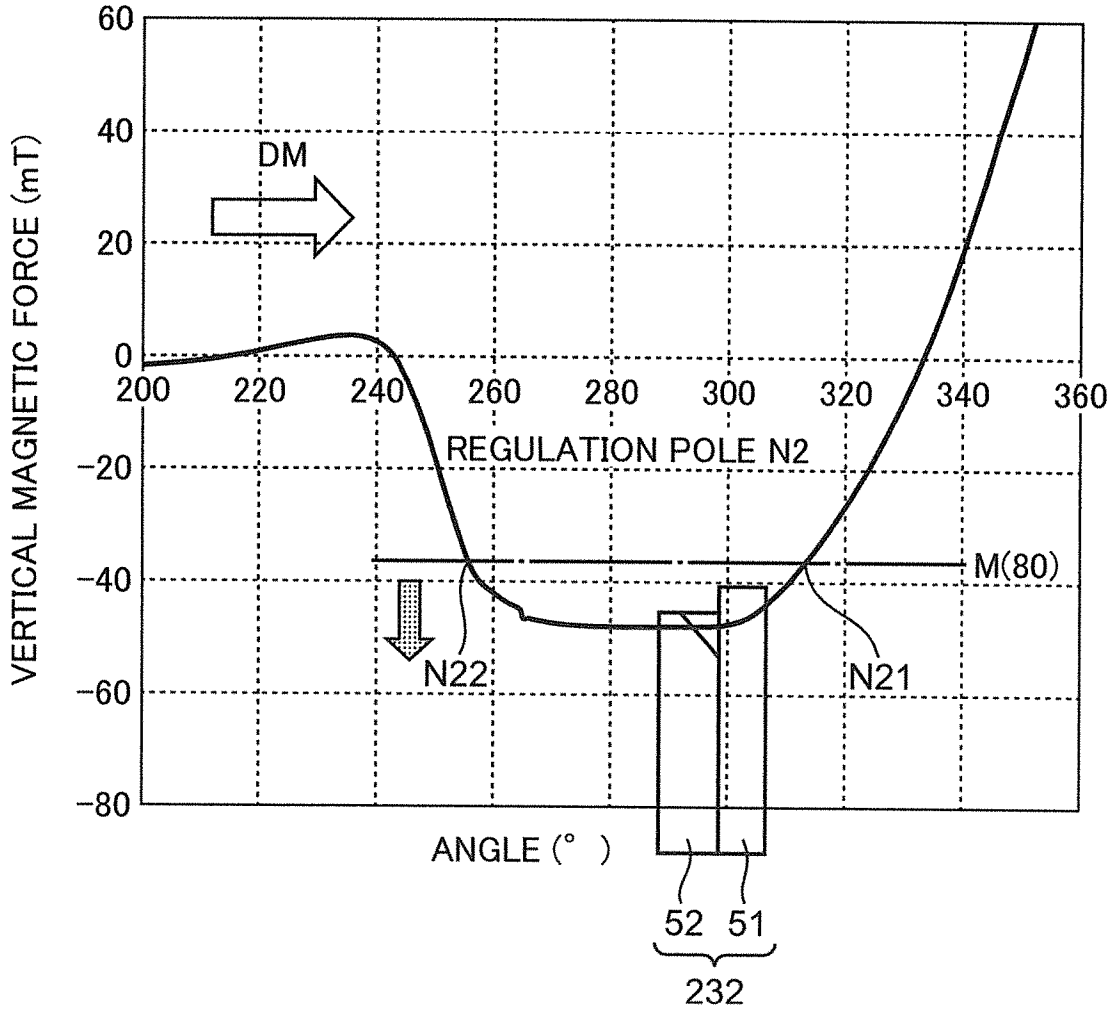
FIG. 5 is a graph showing the position of the layer thickness regulating member in relation to a magnetic force distribution of a regulation pole of the developing roller according to the first embodiment of the present disclosure.
Figure 6:
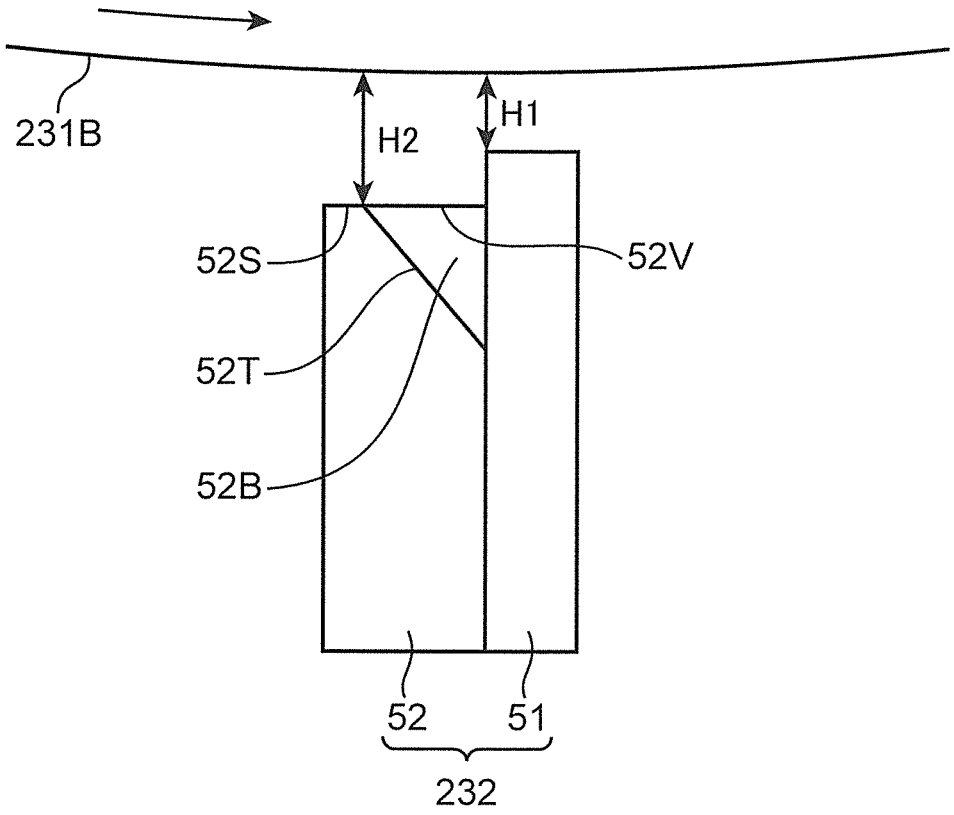
FIG. 6 is a schematic sectional view showing the developing roller and the layer thickness regulating member according to the first embodiment of the present disclosure.
Figure 7:
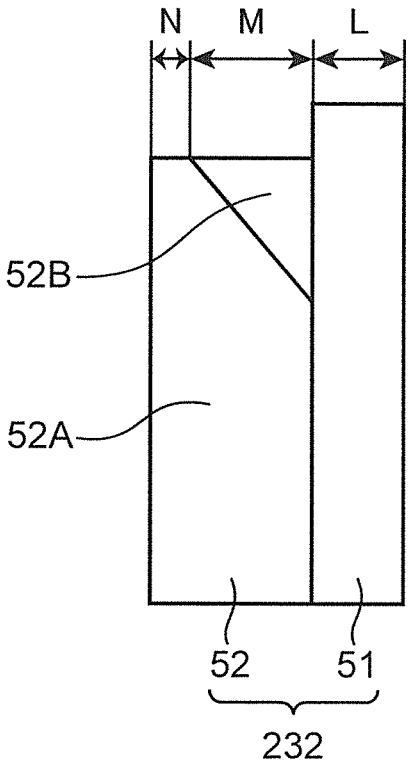
FIG. 7 is a schematic sectional view showing the layer thickness regulating member according to the first embodiment of the present disclosure.

FIG. 3 is a schematic sectional view showing the developing roller 231 and the layer thickness regulating member 232 according to this embodiment. FIG. 4 is a schematic view showing a state of a magnetic field formed between the developing roller 23 and the layer thickness regulating member 231 according to this embodiment. FIG. 5 is a graph showing the position of the layer thickness regulating member 232 in relation to a magnetic force distribution of the regulation pole N2 of the developing roller 231 according to this embodiment. In FIG. 5, an arrow DM indicates a conveying direction of the developer and a dashed-dotted line M(80) indicates a magnetic force which is 80% of a peak magnetic force of the regulation pole N2. FIG. 6 is a schematic sectional view showing the developing roller 231 and the layer thickness regulating member 232 according to this embodiment. FIG. 7 is a schematic sectional view showing the layer thickness regulating member 232 according to this embodiment.

The layer thickness regulating member 232 includes a regulating body portion 51 and an upstream regulating portion 52 (FIG. 3).

The regulating body portion 51 is made of a magnetic material and regulates the layer thickness of the developer being conveyed toward the developing position. As shown in FIG. 3, the regulating body portion 51 is a plate-like member extending along a radial direction of the sleeve 231B. The regulating body portion 51 has a first facing surface 51A, a first upstream side surface 51B and a first downstream side surface 51C. The first facing surface 51A is formed by a flat surface arranged at a predetermined distance from the sleeve 231B. The first upstream side surface 51B is formed by a flat surface connected to an upstream end part of the first facing surface 51A in the rotating direction of the sleeve 231B and extending along the radial direction of the sleeve 231B. The first downstream side surface 51C is formed by a flat surface connected to the first facing surface 51A on a side opposite to the first upstream side surface 51B in the rotating direction and extending along the radial direction of the sleeve 231B. Note that the first upstream side surface 51B is formed by the flat surface as described above, and an axis of rotation of the sleeve 231B of the developing roller 231 is arranged on an extension of the first upstream side surface 51B.

The upstream regulating portion 52 is connected to the first upstream side surface 51B of the regulating body portion 51. The upstream regulating portion 52 has a second facing surface 52K, a second downstream side surface 52J and a second upstream side surface 52L. The second facing surface 52K is formed by a flat surface arranged to face the sleeve 231B at a larger distance from the sleeve 231B than the first facing surface 51A. The second downstream side surface 52J is formed by a flat surface connected to a downstream end part of the second facing surface 52K in the rotating direction, extending along the radial direction and held in close contact with the first upstream side surface 51B. The second upstream side surface 52L is formed by a flat surface connected to the second facing surface 52J on a side opposite to the second downstream side surface 52J in the rotating direction and extending along the radial direction of the sleeve 231B.

Further, the second facing surface 52K of the upstream regulating portion 52 has a nonmagnetic facing surface 52V and an upstream magnetic facing surface 52S (FIG. 6). The nonmagnetic facing surface 52V is formed by a flat surface arranged downstream of the second facing surface 52K in the rotating direction and made of a nonmagnetic material. Further, the upstream magnetic facing surface 52S is formed by a flat surface arranged upstream of the second facing surface 52K in the rotating direction and made of a magnetic material.

Furthermore, in this embodiment, the upstream regulating portion 52 is composed of an upstream magnetic member 52A and a nonmagnetic member 52B since the second facing surface 52K has the nonmagnetic facing surface 52V and the upstream magnetic facing surface 52S described above.

The upstream magnetic member 52A has the aforementioned upstream magnetic facing surface 52S and an inclined surface 52T connecting a downstream end part of the upstream magnetic facing surface 52S in the rotating direction and the first upstream side surface 51B of the regulating body portion 51. The upstream magnetic member 52A is formed by a plate-like magnetic member. The inclined surface 52T of the upstream magnetic member 52A is inclined away from the sleeve 231B along the rotating direction of the sleeve 231B.

The nonmagnetic member 52B is fitted into a wedge-shaped space (recess) between the inclined surface 52T and the regulating body portion 51. In other words, the nonmagnetic member 52B has the aforementioned nonmagnetic facing surface 52V and is arranged between the inclined surface 52T and the first upstream side surface 51B. The nonmagnetic member 52B is a nonmagnetic bar-like member having a triangular cross-section and extending along an axial direction of the sleeve 231B. Note that the nonmagnetic facing surface 52V and the upstream magnetic facing surface 52S are set flush with each other. As a result, the layer thickness regulating member 232 is easily configured by arranging the nonmagnetic member 52B between the regulating body portion 51 and the upstream magnetic member 52A.

With reference to FIG. 4, in the layer thickness regulating member 232 according to this embodiment, a first magnetic field concentration point T1 is formed on an upstream end part of the first facing surface 51A of the regulating body portion 51, and a second magnetic field concentration point T2 is formed on a boundary between the nonmagnetic facing surface 52V and the upstream magnetic facing surface 52S of the upstream regulating portion 52.

Generally around a layer thickness regulating member, developer is retained on a point where a magnetic force is concentrated. If the developer in this retention part increases, a pressure of the developer in the retention part increases. If this pressure of the developer becomes larger than a regulating force (shield) by a magnetic force, the developer is conveyed to a side downstream of the magnetic field concentration point (the developer passing through the layer thickness regulating member). In a conventional developing device, the developer has been regulated by enhancing a magnetic force on a single magnetic field concentration point. On the other hand, in this embodiment, a pressure of the developer on the first magnetic field concentration point T1 is reduced and the second magnetic field concentration point T2 is newly formed on the side upstream of the first magnetic field concentration point T1.

As a result, the developer is hardly strongly jammed in an area between the first magnetic field concentration point T1 of the regulating body portion 51 and the second magnetic field concentration point 12 of the upstream regulating portion 52. Thus, even if the sleeve 231B of the developing roller 231 is rotated at a higher speed than before, the developer is stably regulated by the layer thickness regulating member 232. This function is also due to a repulsion action between magnetic brushes. Thus, the first and second magnetic field concentration points T1, T2 are both arranged to face the regulation pole N2. Further, when seen in a cross-section of FIG. 4, the two magnetic field concentration points are not present over wide surfaces in a retention part of the developer, but presents nearly at points, whereby a torque increase of the developing roller 231 and the deterioration of the toner and the carrier are suppressed. Therefore, the nonmagnetic facing surface 52V made of the nonmagnetic material is arranged between the first and second magnetic field concentration points T1, T2.

Further, as shown in FIG. 6, the inclined surface 52T is inclined to be more distant from the sleeve 231B toward the regulating body portion 51. Thus, as shown in FIG. 4, magnetic force lines propagating toward the nonmagnetic member 52B tend to extend in a curved manner toward the upstream side in the rotating direction of the sleeve 231B on a tip part (lower end part). Therefore, a difference of the magnetic field is made clear between the first magnetic field concentration point T1 and a side upstream of this point. As a result, the magnetic field is more concentrated on the first magnetic field concentration point T1 and the retention part of the developer is stably formed between the first and second magnetic field concentration points T1, T2.

Further, to stably exhibit the above functions and effects, the first downstream side surface 51C (FIG. 3) of the regulating body portion 51 is also desirably facing the regulation pole N2. If the first downstream side surface 51C is facing the magnetic pole different from the regulation pole N2, the polarity of the magnetic pole may become partially different in the first facing surface 51A of the regulating body portion 51. In this case, directions of magnetic lines are inverted in the first facing surface 51A and the conveyance of the developer may possibly become unstable.

Further, with reference to FIG. 5, the layer thickness regulating member 232 is so arranged to face the developing roller 231 that the first facing surface 51A of the layer thickness regulating member 232 and the nonmagnetic facing surface 52V and the upstream magnetic facing surface 52S of the second facing surface 52K are all included in an area of the regulation pole N2 between a reference position (N21 of FIG. 5) on a downstream side in the rotating direction and a reference position (N22 of FIG. 5) on an upstream side in the rotating direction, a magnetic force at each reference position being 80% of a maximum magnetic force (peak magnetic force) of the regulation pole N2, in a distribution of components in the radial direction (radial direction components, also referred to as vertical components) of a magnetic force (magnetic flux density) of the fixed magnet 231A on the sleeve 231B along the circumferential direction (rotating direction). Specifically, in this embodiment, the first facing surface 51A, the nonmagnetic facing surface 52V and the upstream magnetic facing surface 52S of the second facing surface 52K are included in a fan-shaped area formed by a straight line passing through a rotation axis of the sleeve 231B and the reference position N21 and a straight line passing through a rotation axis of the developing roller 231 and the reference position N22 in a cross-section perpendicular to the axial direction of the developing roller 231. According to this configuration, the entire area from the upstream end part of the upstream regulating portion 52 to the downstream end part of the regulating body portion 51 receives the magnetic field having the same polarity. Further, the layer thickness regulating member 232 is arranged in an area where a change in vertical magnetic force of the regulation pole N2 along the circumferential direction is small. Thus, a change of magnetic attraction force acting on the developer is small and stress on the developer is suppressed.

Further, in this embodiment, if M1 (mT) denotes a magnetic force of a component in a radial direction of the regulation pole N2 at a position corresponding to the upstream end part (first magnetic field concentration point T1) of the first facing surface 51A in the rotating direction in the circumferential direction of the sleeve 231B and M2 (mT) denotes a magnetic force of a component in the radial direction of the regulation pole N2 at a position corresponding to the boundary position (second magnetic field concentration point T2) between the nonmagnetic facing surface 52V and the upstream magnetic facing surface 52S in the circumferential direction, a larger magnetic force MB (mT) and a smaller magnetic force MS (mT), out of M1 and M2, satisfy a relationship of $MS/MB \geq 0.8$. If a change of a magnetic force component (vertical magnetic force) in the radial direction of the regulation pole N2 is large for the magnetic attraction force, which is a force attracting the developer to the developing roller 231, the magnetic attraction force increases. Thus, to reduce stress on the developer between the nonmagnetic facing surface 52V and the sleeve 231B, it is desirable to suppress a change of a magnetic field formed by the magnetic force components in the radial direction. By satisfying the relationship of $MS/MB \geq 0.8$, such stress on the developer is reduced. In this case, a balance of the developer regulating force at the first and second magnetic field concentration points T1, T2 arranged across the nonmagnetic facing surface 52V is hardly lost and the flow of the developer is easily stabilized. Thus, the occurrence of conveyance unevenness of the developer having passed through the layer thickness regulating member 232 is further suppressed. Further, a torque increase of the developing roller 231 and the deterioration of the developer are suppressed by reducing stress on the developer.

Further, with reference to FIG. 7, if L (mm) denotes a length of the first facing surface 51A in the circumferential direction of the sleeve 231B, M (mm) denotes a length of the nonmagnetic facing surface 52V and N (mm) denotes a length of the upstream magnetic facing surface 52S, relationships of $0.5 \leq M \leq 5$ and $0.1 \leq N \leq 0.5$ are desirably satisfied. According to this configuration, the occurrence of conveyance unevenness and drive unevenness is further suppressed and the deterioration of the developer and the occurrence of fogging are suppressed.

Further, with reference to FIG. 6, H1 (mm) denotes an interval between the upstream end part (first magnetic field concentration point T1) of the first facing surface 51A in the rotating direction and the sleeve 231B and H2 (mm) denotes an interval between the boundary position (second magnetic field concentration point T2) between the nonmagnetic facing surface 52V and the upstream magnetic facing surface 52S and the sleeve 231B, a relationship of $1.2\times H1 \leq H2 \leq 3$ is desirably satisfied. By satisfying $H2 \leq 3$, the magnetic force concentration at the second magnetic field concentration point T2 is stably maintained and the developer regulating force is sufficiently ensured. Further, by satisfying $H2 \geq 1.2\times H1$, the clogging of the developer between the layer thickness regulating member 232 and the sleeve 231B is suppressed. In other words, an increase in compression force in the retention part of the developer around the layer thickness regulating member 232 is suppressed and the occurrence of drive unevenness in the rotation of the sleeve 231B and the aggregation of the developer is suppressed. Further, the occurrence of conveyance unevenness of the developer due to the instability of the retention part of the developer is further suppressed.

Note that, in this embodiment, the layer thickness regulating member 232 is arranged below the developing roller 231 as shown in FIG. 2. As compared to the case where the layer thickness regulating member 232 is arranged above the developing roller 231, a gravitational force acts on the developer in a direction different from a direction in which the developer is attracted by the magnetic force of the developing roller 231. Thus, a drive torque of the developing roller 231 can be reduced. In the retention part between the first and second magnetic field concentration points T1, T2, the deterioration of the developer is accelerated if an excessive pressure is applied to the developer. Thus, in this embodiment, the deterioration of the developer is suppressed by reducing a pressure in the retention part. Specifically, if the layer thickness regulating member 232 is arranged below the developing roller 231, the developer is less deteriorated and a life of the developer is extended.

Further, in this embodiment, the layer thickness regulating member 232 is easily configured by fitting (arranging) the nonmagnetic member 52B between the regulating body portion 51 and the upstream magnetic member 52A.

Further, in this embodiment, the first upstream side surface 51B of the regulating body portion 51 is formed by the flat surface and the axis of rotation of the sleeve 231B of the developing roller 231 is arranged on the extension of the first upstream side surface 51B. Thus, a concentration point of a magnetic force (first magnetic field concentration point T1) can be stably formed on the upstream end part of the first facing surface 51A.

Figure 8:
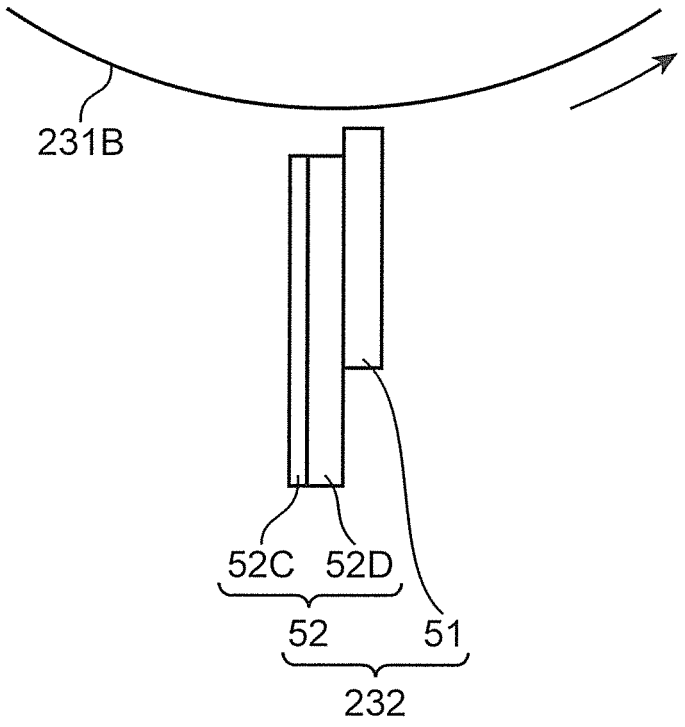
FIG. 8 is a schematic sectional view showing a developing roller and a layer thickness regulating member according to a second embodiment of the present disclosure.
Figure 9:
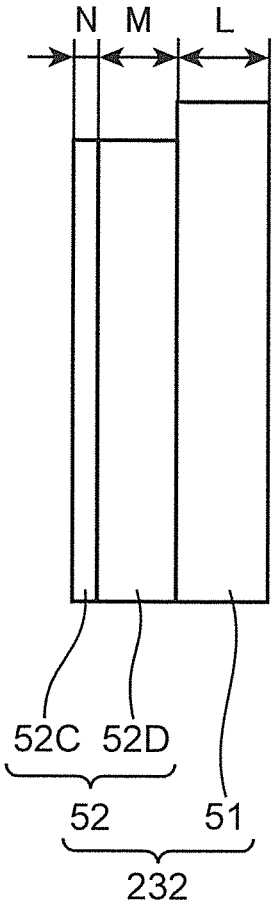
FIG. 9 is a schematic sectional view showing a tip part of the layer thickness regulating member according to the second embodiment of the present disclosure.

Next, a layer thickness regulating member 232 according to a second embodiment of the present disclosure is described. Note that since this embodiment differs from the first embodiment in the structure of the upstream regulating portion 52, the following description is centered on points of difference. FIGS. 8 and 9 are schematic sectional views showing a developing roller 231 and the layer thickness regulating member 232 according to this embodiment. Note that, in FIGS. 8 and 9, members having the same functions as in the first embodiment are denoted by the same reference signs as in FIGS. 3 to 7.

In this embodiment, an upstream regulating portion 52 has an upstream magnetic member 52C and a nonmagnetic member 52D. The upstream magnetic member 52C has the aforementioned upstream magnetic facing surface 52S and is made of a plate-like magnetic material extending in a radial direction of a sleeve 231B. Further, the nonmagnetic member 52D has the aforementioned nonmagnetic facing surface 52V and is made of a plate-like nonmagnetic material extending in the radial direction. Also in this configuration, a first magnetic field concentration point T1 is formed on an upstream end part of a first facing surface 51A of the regulating body portion 51 in a rotating direction. Further, a second magnetic field concentration point T2 is formed on a boundary between the nonmagnetic facing surface 52V and the upstream magnetic facing surface 52S of the upstream regulating portion 52. Thus, developer is hardly strongly jammed in an area between the first magnetic field concentration point T1 of the regulating body portion 51 and the second magnetic field concentration point T2 of the upstream regulating portion 52. Therefore, even if the sleeve 231B of the developing roller 231 is rotated at a higher speed than before, the developer is stably regulated by the layer thickness regulating member 232.

Further, also in this embodiment, the layer thickness regulating member 232 is easily configured by arranging the nonmagnetic member 52D between the regulating body portion 51 and the upstream magnetic member 52C.

EXAMPLES

Next, the present disclosure is further described on the basis of Examples. Note that the present disclosure is not limited to the following Examples. Further, each experiment was conducted under the following conditions:

<Common Experimental Conditions>

Photoconductive drum 20: amorphous silicon photoconductor having a diameter ϕ of 30 mm, a surface potential (blank part) Vo=+250 to +300 V, a surface potential (image part) VL=20 V Printing speed: 55 pages/min Developer conveying amount (after layer thickness regulation) on developing roller 231: 200 to 400 g/m$^2$ Carrier: volume average particle diameter of 35 μm Toner: volume average particle diameter of 6.8 μm, positively charging property Further, conditions of the developing roller 231 used in the experiments were as follows.

Developing roller 231: diameter ϕ of 20 mm, a plurality of recesses adjacently arranged in circumferential and axial directions were formed in the circumferential surface of the sleeve 231B. The recesses had an elliptical shape having a major axis length of 0.8 mm and a minor axis length of 0.2 mm and were arranged in 80 rows along the circumferential direction.

Circumferential speed ratio of the developing roller 231 to photoconductive drum 20: 1.4 to 2.0 (trail direction)

Gap between developing fuller 231 and photoconductive drum 20: 0.25 to 0.50 mm Development bias: direct:current bias=+100 V, alternating-current bias=Vpp 4.2 kV, frequency of 3.7 kHz, duty of 50%, rectangular wave (flute that the layer thickness regulating member 232 was also at the same potential as the developing roller 231)

Regulation pole N2 of fixed magnet 231A: A peak position of the N2 pole was arranged at a position of 7° upstream of the first upstream side surface 51B of the regulating body portion 51 of the layer thickness regulating member 232 in the rotating direction of the sleeve 231B. A peak magnetic force (maximum magnetic flux density) of the radial component of the magnetic force of the N2 pole was 45 mT, the radial component of the magnetic force at the position facing the first magnetic field concentration point T1 was 45 mT, and the radial component of the magnetic force at the position facing the second magnetic field concentration point T2 was 42 mT. The regulation pole N2 had a flat shape (range of 9.6 mm when being converted into a circumferential length on the sleeve 231B) in which an area where the radial component of the magnetic force was 36 mT or more was continuously distributed by 55° along the circumferential direction. Note that the magnetic force of the developing roller 231 was measured using GAUSS METER Model GX-100 manufactured by Nihon Denji Sokki Co., Ltd.

<Developer Conditions>

The following two types of developer were evaluated to evaluate conveyance performance for different types of developer.

Condition 1: Ferrite carrier (70 emu/g)+toner (toner density of 5%)

Condition 2: Resin carrier (70 emu/g)+toner (toner density of 10%)

<Layer Thickness Regulating Member Conditions>

Experiments were conducted as follows using the layer thickness regulating member 232 according to the previous first embodiment (FIGS. 3, 6 and 7) as Example 1 and the layer thickness regulating member 232 according to the second embodiment (FIGS. 8 and 9) as Example 2.

Example 1

Regulating body portion 51: Made of SUS 430, magnetic, L=1.5 mm

Upstream magnetic member 51A: Made of SECC (electrogalvanized zinc plated steel), M+N=1.5 mm, angle of inclination of inclined surface 52T=45°, H2=H1×2

Nonmagnetic member 52B: Made of resin

Example 2

Regulating body portion 51: Made of SUS 430, magnetic, L=1.5 mm

Upstream magnetic member 52C: Made of SUS 430, N=0.3 mm, H2=H1×2

Nonmagnetic member 52D: Made of aluminum, M=1.5 mm

Figure 10:
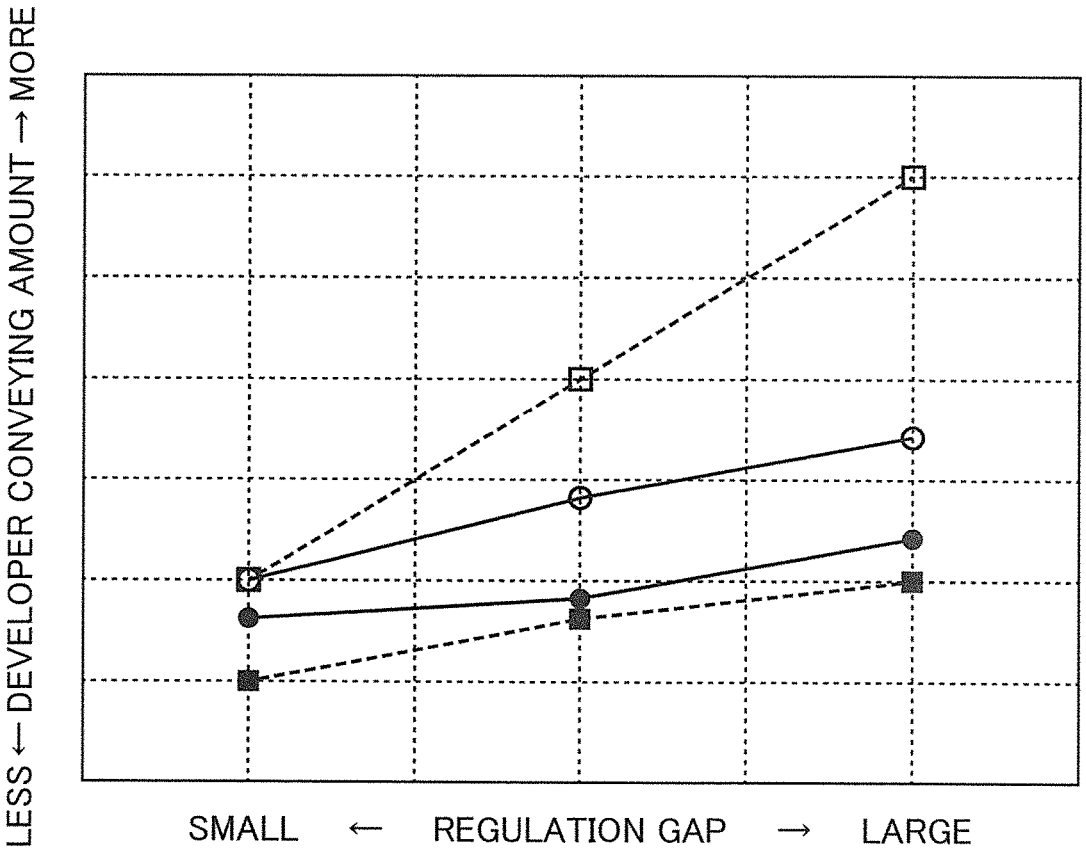
FIG. 10 is a graph showing relationships between a regulation gap and a developer conveying amount in Examples of the present disclosure and Comparative Example.
Figure 11:
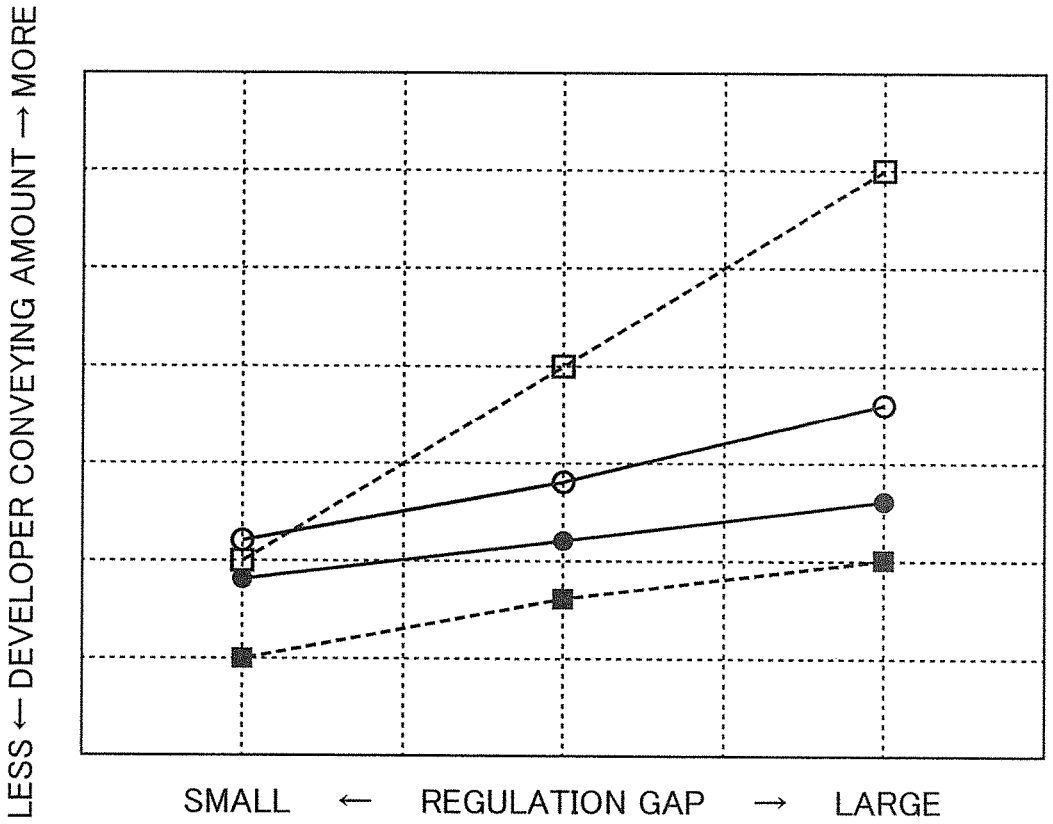
FIG. 11 is a graph showing relationships between the regulation gap and the developer conveying amount in Examples of the present disclosure and Comparative Example.
Figure 12:
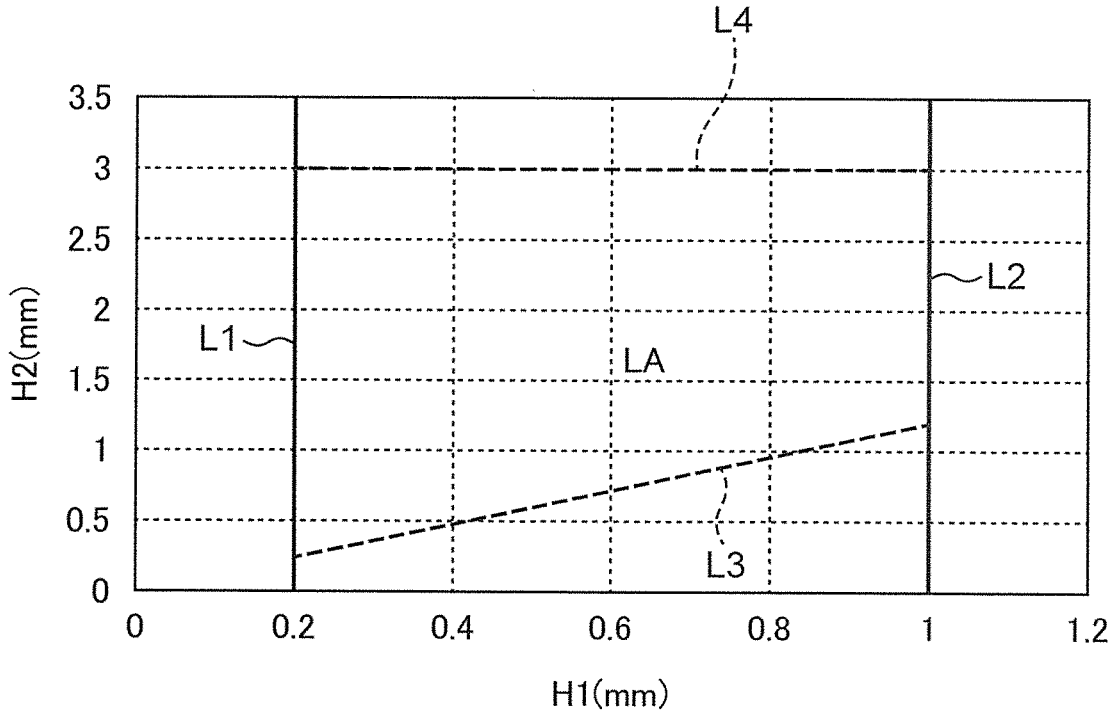
FIG. 12 is a graph showing a relationship between the shape of the layer thickness regulating member and the developer conveying amount.
Figure 13:
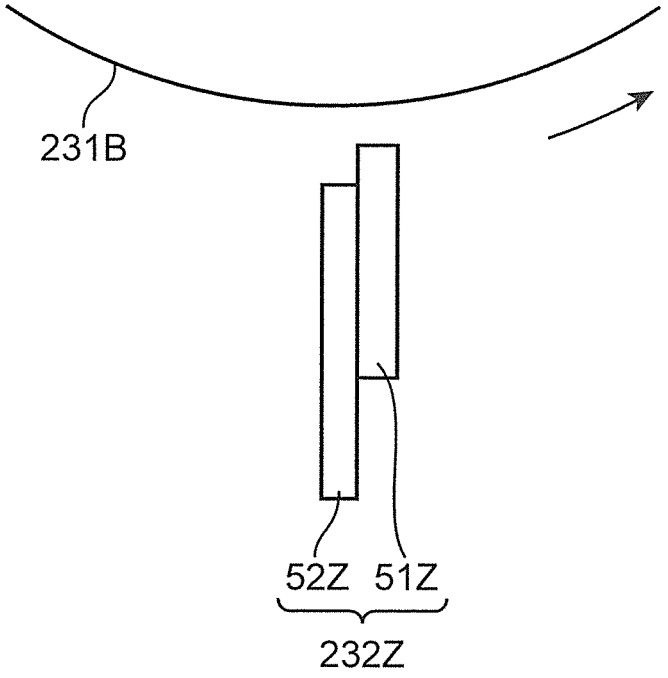
FIG. 13 is a schematic sectional view showing another layer thickness regulating member to be compared to the layer thickness regulating members according to the embodiments of the present disclosure.
Figure 14:
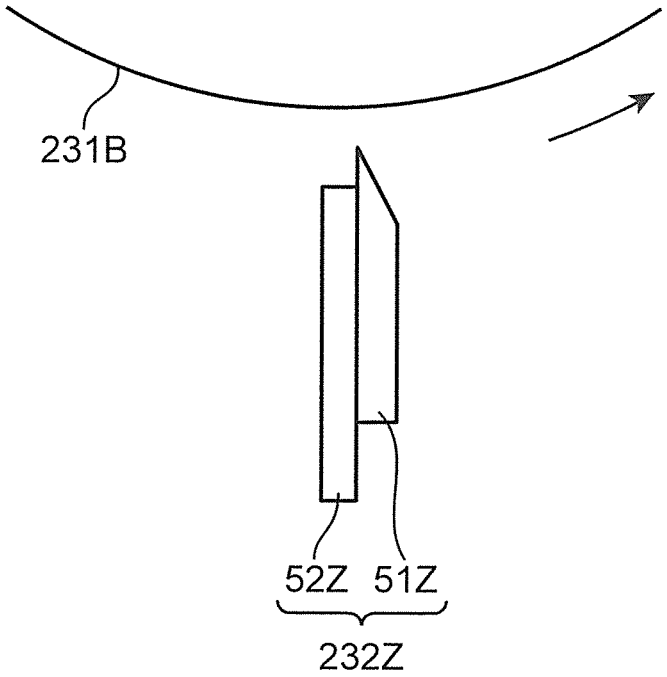
FIG. 14 is a schematic sectional view showing another layer thickness regulating member to be compared to the layer thickness regulating members according to the embodiments of the present disclosure.

FIGS. 10 and 11 are graphs showing relationships between a regulation gap (H1) of the layer thickness regulating member 232 and the developer conveying amount in Examples and Comparative Example of the present disclosure. In FIG. 10, data represented by white circles was obtained when Example 1 was used under conditions 1 and data represented by black circles was obtained when Example 1 was used under conditions 2. Further, data represented by white squares was obtained when Comparative Example 1 was used under the conditions 1 and data represented by black squares was obtained when Comparative Example 1 was used under the conditions 2. Similarly, in FIG. 11, data represented by white circles was obtained when Example 2 was used under the conditions 1 and data represented by black circles was obtained when Example 2 was used under the conditions 2. Further, data represented by white squares was obtained when Comparative Example 1 was used under the conditions 1 and data represented by black squares was obtained when Comparative Example 1 was used under the conditions 2. FIG. 12 is a graph showing a relationship between the shape of the layer thickness regulating member 232 and the developer conveying amount. Note that the developer conveying amount on the developing roller 231 was measured in a range having a rectangular shape of 5 mm (circumferential direction)×5 mm (axial direction) on a side downstream of the layer thickness regulating member 232, and maximum and minimum values thereof were plotted. FIGS. 13 and 14 are schematic sectional views showing other layer thickness regulating members 232Z to be compared to the layer thickness regulating members 232 according to the embodiments of the present disclosure. In the layer thickness regulating member 232Z shown in FIG. 13, a magnetic upstream regulating portion 52Z is arranged upstream of a magnetic regulating body portion 51Z. Further, in the layer thickness regulating member 232Z shown in FIG. 14, a tip part of the regulating body portion 51Z of FIG. 13 is set to have an acute angle. In the following evaluations, the layer thickness regulating member 232Z shown in FIG. 13 was Comparative Example 1.

With reference to FIG. 10, since Example 1 of the present disclosure has a plurality of magnetic field concentration points, a variation of the developer conveying amount is smaller and a gradient in relation to a change of the regulation gap is smaller as compared to Comparative Example 1. Specifically, even if the regulation gap changes due to component tolerances, assembly variation and the like, the developer conveying amount hardly varies and robustness is improved. Further, in Example 1, a difference of the developer conveying amount is smaller than in Comparative Example 1 with respect to a difference of the developer (conditions 1, conditions 2).

Similarly, with reference to FIG. 11, since Example 2 of the present disclosure also has a plurality of magnetic field concentration points, a variation of the developer conveying amount is smaller and a gradient in relation to a change of the regulation gap is smaller as compared to Comparative Example 1. Results similar to those of Example 1 are also obtained for other points.

Further, FIG. 12 shows results (latitude LA, window) of developer conveying property when the interval H1 (mm) between the upstream end part of the first facing surface 51A in the rotating direction and the sleeve 231B and the interval H2 (mm) between the boundary position between the nonmagnetic facing surface 52V and the upstream magnetic facing surface 52S and the sleeve 231B were respectively changed. In a range of H1<0.2 mm (range to the left of a first boundary line L1), the developer might be clogged in the layer thickness regulating member 232 since H1 was small, but such a phenomenon did not occur in a range of H1≤0.2 mm. Further, in a range of H1>1 min (range to the right of a second boundary line L2), a developer conveyance failure might occur since H1 was large, but such a phenomenon did not occur in a range of H1≤1 mm. Further, in a range of 1.2×H1>H2 (below a third boundary line L3), a compression force might increase in the retention part of the developer around the layer thickness regulating member 232 and drive unevenness in the rotation of the sleeve 231B and the aggregation of the developer might occur, but such a phenomenon did not occur in a range of 1.2×H1≤H2. Further, in a range of H2>3 mm (above a fourth boundary line L4), developer conveyance unevenness might occur due to the instability of the retention part of the developer, but such a phenomenon did not occur in a range of H≤3. From these points, it is desirable to satisfy a relationship of 1.2×H1≤H2≤3.

Further, Table 1 shows results in evaluating a variation width of the developer conveying amount on the developing roller 231, the presence or absence of conveyance unevenness and the torque of the developing roller 231 when the length M of the nonmagnetic facing surface 52V was changed. Note that, in this evaluation, the layer thickness regulating member 232 of Example 2 (FIG. 9) was used and a shape having L=1.5 mm, M=1.5 mm and N=0.3 mm was adopted as a standard condition. The value of M was changed with respect to this standard condition with L and N kept fixed.

TABLE 1

| M (mm) | 0.3 | 0.5 | 1.5 | 3 | 5 | 7 |
|---|---|---|---|---|---|---|
| Conveyance Amount Variation Width (g/m$^2$) | ±28 | ±15 | ±15 | ±15 | ±15 | ±15 |
| Conveyance Unevenness | X | ○ | ○ | ○ | ○ | ○ |
| Torque | ○ | ○ | ○ | ○ | ○ | X |

As shown in Table 1, the variation width of the developer conveying amount is small and conveyance unevenness (partial variation of conveying amount) does not occur in a range of 0.5 mm≤M. As a result, the occurrence of image density unevenness is suppressed. Further, in a range of M≤5 mm, a torque increase of the developing roller 231 is suppressed. As a result, the occurrence of drive unevenness is suppressed and the deterioration of the developing roller and the occurrence of fogging are suppressed by satisfying a condition of 0.5≤M≥5.

Further, Table 2 shows results on the variation width of the developer conveying amount on the developing roller 231 and the presence or absence of conveyance unevenness when the length N of the upstream magnetic facing surface 52S was changed. Similarly to the above, the value of N was changed with respect to the standard condition with L and M kept fixed. When the length N of the upstream magnetic facing surface 52S becomes shorter than 0.1 mm, the magnetic field may not be sufficiently concentrated since the magnetic body is too thin. As a result, the retention part of the developer on the side upstream of the first magnetic field concentration point T1 tends to become unstable. As a result, conveyance unevenness easily occurs. Further, if the length N of the upstream magnetic facing surface 52S becomes longer than 0.5 mm, edge parts of the upstream magnetic member 52C at two positions facing the developing roller 231 are distant from each other and the concentration of the magnetic field may be dispersed to weaken the magnetic field. On the other hand, if the length N is equal to or longer than 0.1 mm and equal to or shorter than 0.5 mm, the magnetic field concentrated on the edge parts of the upstream magnetic member 52C at the two positions facing the developing roller 231 acts as one magnetic field, wherefore the magnetic field is more strongly concentrated. As a result, the variation width of the developer conveying amount is small and conveyance unevenness is suppressed as shown in Table 2.

TABLE 2

| N (mm) | 0.05 | 0.08 | 0.1 | 0.3 | 0.5 | 0.7 |
|---|---|---|---|---|---|---|
| Conveyance Amount Variation Width (g/m$^2$) | ±25 | ±22 | ±15 | ±14 | ±15 | ±20 |
| Conveyance Unevenness | X | X | ○ | ○ | ○ | X |

Further, Table 3 shows results on the vertical magnetic force (radial magnetic force) of the regulation pole N2 at a position where the first magnetic field concentration point T1 is facing the fixed magnet 231A (first facing position of Table 3), the vertical magnetic force (radial magnetic force) of the regulation pole N2 at a position where the second magnetic field concentration point T2 is facing the fixed magnet 231A (second facing position of Table 3), a magnetic force ratio of these vertical magnetic forces and the presence or absence of conveyance unevenness under these conditions. As shown in Table 3, it is confirmed that conveyance unevenness does not occur when the larger magnetic force MB (mT) and the smaller magnetic force MS (mT), out of M1 and M2, satisfy a relationship of MS/MB≥0.8.

TABLE 3

| Roller No. | Vertical Magnetic Force (mT) at First Facing Position | Vertical Magnetic Force (mT) at Second Facing Position | Magnetic Force Ratio (%) | Conveyance Unevenness |
|---|---|---|---|---|
| No. 1 | 52 | 45 | 87 | ○ |
| No. 2 | 56 | 42 | 75 | X |
| No. 3 | 45 | 37 | 82 | ○ |
| No. 4 | 42 | 47 | 89 | ○ |
| No. 5 | 38 | 48 | 79 | X |

Note that, when the gap (blade gap) between the layer thickness regulating member 232 and the developing roller 231 was adjusted and similar evaluations were conducted in a range of the developer conveying amount on the sleeve 231B of 100 g/m$^2$ or more and 400 g/m$^2$ or less for each of the above experiments, similar results were obtained for the effect of suppressing conveyance unevenness and the like. Further, when evaluations similar to the above were conducted in a range of the toner density of 5% or more and 12% or less, similar results were obtained for the effect of suppressing conveyance unevenness and the like. Also when similar evaluations were conducted in a range of the diameter of the developing roller 231 of 12 mm or longer and 35 mm or shorter and in a range of the circumferential speed of the photoconductive drum 20 of 200 mm/sec or higher and 400 mm/sec or lower, similar results were obtained for the effect of suppressing conveyance unevenness and the like.

The developing device 23 and the image forming apparatus 10 provided with the same according to each embodiment of the present disclosure have been described in detail above. According to such an image forming apparatus 10, the developer is stably regulated by the layer thickness regulating member 232 even if the sleeve 231B of the developing roller 231 is rotated at a higher speed than before. As a result, an electrostatic latent image on the photoconductive drum 20 is stably developed into a toner image. Note that each of the above embodiments is based on the following new findings on the conventional cause of conveyance unevenness. If a pressure of a developing roller to push developer around a layer thickness regulating member from an upstream side by rotating exceeds a magnetic regulating force, the developer (magnetic brush) is conveyed to a side downstream of the layer thickness regulating member. If the developer is conveyed in this way, a pressure in a retention part of the developer on the side upstream of the layer thickness regulating member decreases, wherefore the force for pushing the developer temporarily becomes weaker. As a result, a developer conveying amount is reduced. If the pressure in the retention part increases, the developer is pushed to a side downstream of the layer thickness regulating member. It was found that conveyance unevenness of the developer occurred by repeating such movements. In each of the above embodiments, the plurality of magnetic field concentration points are distributed on the layer thickness regulating member, whereby conveyance unevenness occurring due to the concentration at one magnetic field concentration points as before is suppressed. Note that the present disclosure is not limited to each of the above embodiments. The present disclosure can be, for example, modified as follows.

(1) Although the angle of inclination of the inclined surface 52T is 45° in the above first embodiment, the present disclosure is not limited to this. The angle of inclination of the inclined surface 52T may be any acute angle. Note that this angle of inclination is preferably in a range of 30° to 70°.

(2) Although the developing device Is a two-component developing device and includes one developing roller 231 in the above embodiments, two developing rollers (toner carrying rollers) may be included such as in known touch-down developing devices.

(3) Further, although the N2 pole has functions as both the draw-up pole and the regulation pole in the above embodiments, the present disclosure is not limited to this. The N2 pole may have the function as the regulation pole and another pole arranged upstream of the N2 pole may have the function as the draw-up pole.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A developing device, comprising:

a housing configured to store developer containing toner and magnetic carrier;

a developing roller including a fixed magnet having a plurality of magnetic poles along a circumferential direction and a sleeve configured to rotate in a predetermined rotating direction around the fixed magnet and carry the developer on a circumferential surface, the developing roller being so supported in the housing as to face a photoconductive drum, on a surface of which an electrostatic latent image is to be formed, at a predetermined developing position and supplying the toner to the photoconductive drum;

a developer stirring member rotatably supported in the housing and configured to stir the developer and supply the developer to the developing roller; and a layer thickness regulating member arranged to face the sleeve of the developing roller and configured to regulate a layer thickness of the developer supplied to the developing roller by the developer stirring member;

wherein:

the fixed magnet has a regulation pole arranged to face the layer thickness regulating member and having a predetermined polarity;

the layer thickness regulating member includes:

a regulating body portion made of a magnetic material and configured to regulate the layer thickness of the developer being conveyed toward the developing position, the regulating body portion having a first facing surface arranged at a predetermined distance from the sleeve, a first upstream side surface connected to an upstream end part of the first facing surface in the rotating direction and extending along a radial direction of the sleeve and a first downstream side surface connected to the first facing surface on a side opposite to the first upstream side surface in the rotating direction; and an upstream regulating portion connected to the first upstream side surface of the regulating body portion, the upstream regulating portion having a second facing surface arranged to face the sleeve at a larger distance from the sleeve than the first facing surface, a second downstream side surface connected to a downstream end part of the second facing surface in the rotating direction, extending along the radial direction and held in close contact with the first upstream side surface and a second upstream side surface connected to the second facing surface on a side opposite to the second downstream side surface in the rotating direction; and the second facing surface of the upstream regulating portion has:

a nonmagnetic facing surface made of a nonmagnetic material and arranged on a downstream end of the second facing surface in the rotating direction; and an upstream magnetic facing surface made of a magnetic material and arranged on an upstream end of the second facing surface which is upstream of the non-magnetic facing surface in the rotating direction.

2. A developing device according to claim 1, wherein:

the layer thickness regulating member is so arranged to face the developing roller that the first facing surface of the layer thickness regulating member and the nonmagnetic facing surface and the upstream magnetic facing surface of the second facing surface are all included in an area of the regulation pole between a reference position on a downstream side in the rotating direction and a reference position on an upstream side in the rotating direction, a magnetic force at each reference position being 80% of a maximum magnetic force of the regulation pole, in a distribution of components in the radial direction of a magnetic force of the fixed magnet on the sleeve along a circumferential direction.

3. A developing device according to claim 2, wherein:

if M1 (mT) denotes a magnetic force of a component in the radial direction of the regulation pole at a position corresponding to the upstream end part of the first facing surface in the rotating direction in the circumferential direction and M2 (mT) denotes a magnetic force of a component in the radial direction of the regulation pole at a position corresponding to a boundary position between the nonmagnetic facing surface and the upstream magnetic facing surface in the circumferential direction for the magnetic force of the fixed magnet on the sleeve, a larger magnetic force MB (mT) and a smaller magnetic force MS (mT), out of M1 and M2, satisfy a relationship of $MS/MB \geq 0.8$.

4. A developing device according to claim 3, wherein:

if M (mm) denotes a length of the nonmagnetic facing surface and N (mm) denotes a length of the upstream magnetic facing surface in a circumferential direction of the sleeve, relationships of $0.5 \leq M \leq 5$ and $0.1 \leq N \leq 0.5$ are satisfied.

5. A developing device according to claim 4, wherein:

if H1 (mm) denotes an interval between the upstream end part of the first facing surface in the rotating direction and the sleeve and H2 (mm) denotes an interval between the boundary position between the nonmagnetic facing surface and the upstream magnetic facing surface and the sleeve, a relationship of $1.2 \times H1 \leq H2 \leq 3$ is satisfied.

6. A developing device according to claim 1, wherein:

the upstream regulating portion includes:

an upstream magnetic member having the upstream magnetic facing surface and an inclined surface connecting a downstream end part of the upstream magnetic facing surface in the rotating direction and the first upstream side surface of the regulating body portion and made of a magnetic material; and a nonmagnetic member having the nonmagnetic facing surface, arranged between the inclined surface and the first upstream side surface and made of a nonmagnetic material; and the upstream magnetic facing surface and the nonmagnetic facing surface are set flush with each other.

7. A developing device according to claim 1, wherein:

the upstream regulating portion includes:

an upstream magnetic member having the upstream magnetic facing surface and made of a plate-like magnetic material extending along the radial direction; and a nonmagnetic member having the nonmagnetic facing surface and made of a plate-like nonmagnetic material extending along the radial direction; and the upstream magnetic facing surface and the nonmagnetic facing surface are set flush with each other.

8. A developing device according to claim 1, wherein:

the first upstream side surface is formed by a flat surface and an axis of rotation of the sleeve of the developing roller is arranged on an extension of the first upstream side surface.

9. An image forming apparatus, comprising:

a developing device according to claim 1;

the photoconductive drum configured such that the toner is supplied thereto from the developing device and a toner image is carried on the circumferential surface; and a transfer unit configured to transfer the toner image from the photoconductive drum to a sheet.

* * * * *